US005907818A

United States Patent [19]

Hebisch et al.

[11] Patent Number: 5,907,818

[45] Date of Patent: May 25, 1999

[54] PROCESS FOR DISPOSING OF EXPLOSIVE ACTIVE MASSES AND DEVICE THEREFOR

[75] Inventors: Heinz Hebisch; Karl-Ernst Knaack; Karl-P. Krzoska, all of Angermünde; Meinrad Lugan, Bad Sachsa; Jörg Rohmann, Kamen; Uwe Rothenstein, Schwedt; Frank Thelemann, Rottlebeode; Roland Traute, Saufen; Lothar Vogel, Schwedt, all of Germany

[73] Assignee: Buck Werke GmbH & Co., Germany

[21] Appl. No.: 08/850,081

[22] Filed: May 2, 1997

[30] Foreign Application Priority Data

May 2, 1996 [DE] Germany ..... 196 17 617

[51] Int. Cl.[6] ..... A62D 3/00

[52] U.S. Cl. ..... 588/202; 110/237; 110/255; 110/346

[58] Field of Search ..... 588/202; 110/237, 110/346, 255

[56] References Cited

U.S. PATENT DOCUMENTS

| | | | |
|---|---|---|---|
| 4,108,088 | 8/1978 | Burden, Jr. | 110/246 |
| 4,732,091 | 3/1988 | Gould | 110/229 |
| 5,096,415 | 3/1992 | Coucher | 432/14 |
| 5,207,176 | 5/1993 | Morhard et al. | 110/246 |
| 5,555,823 | 9/1996 | Davenport | 110/346 |
| 5,644,997 | 7/1997 | Martin et al. | 110/246 |
| 5,711,235 | 1/1998 | May et al. | 110/257 |

FOREIGN PATENT DOCUMENTS

| | | | |
|---|---|---|---|
| 42 21 343 C1 | 8/1993 | Germany | F42D 5/04 |
| 42 21 344 C1 | 11/1993 | Germany | F42D 5/04 |
| 44 11 655 C1 | 6/1995 | Germany | F42D 5/04 |
| 44 44 809 C1 | 11/1995 | Germany | F42D 5/04 |
| 195 09 196 C1 | 2/1996 | Germany | F42D 5/04 |

*Primary Examiner*—Ngoclan Mai
*Attorney, Agent, or Firm*—Pendorf & Cutliff

[57] ABSTRACT

The present invention refers to a process for disposing of materials which are explosive active masses and/or contain them comprising the following steps:

feeding the materials to be disposed off in a rotary cylindrical furnace (1), conveying the materials into a reaction zone and simultaneously forming compartments of the materials during conveyance, with the materials being thermally reacted in an oxygen-containing environment and the reaction products being fractionately discharged in the form of solid, liquid and gaseous products.

34 Claims, 2 Drawing Sheets

PROCESS FOR DISPOSING OF EXPLOSIVE ACTIVE MASSES AND DEVICE THEREFOR

BACKGROUND OF THE INVENTION

1. Field of the Invention

The present invention refers to a process for disposing of materials which are explosive active masses and/or contain them, a device for carrying out said process and also a waste disposal plant.

2. Description of the Related Art

Materials which are or contain explosive active masses such as, for example, pyrotechnically active masses, propellants, smoke compositions and irritants, subcaliber ammunition, in particular fixed ammunition and phosphorus-containing ammunition, have to be disposed of once they can no longer be put to use due to expiry of their storage life. This group of substances to be disposed of also comprises trinitrotoluene, hexogen, octogen, nitropenta, tetryl as single components or in the form of mixtures. A safe mechanical separation of the active masses is in this case not possible without danger due to the pyrotechnical or explosive potential and to the high compactness of the active mass or can only be technically carried out with disproportionate expenditure.

The materials to be disposed of according to the invention generally have an outer metal shell, an initiator and the active mass. This metal shell is, as a rule, inert during reaction, whereas the propellants for the thermal reaction react during intended use as well as during waste disposal. As propellants, in particular cellulose nitrate, nitroglycerin, dinitrotoluene, trinitrotoluene as well as various stabilizers are applicable. In particular in the case of incendiary and tracer projectiles, the ammunition also contains phosphorus in varying amounts.

If luminaries are used, they generally preferably consist of an aluminum shell, an igniter and the active mass with the active mass comprising a light metal powder as energy supplier, an oxidizing agent capable of splitting off oxygen, an organic binding agent for mechanically solidifying the mixture and optionally mineral and/or organic color enhancers. As a rule, magnesium is used as light metal powder since other possible metals are either toxicologically hazardous or too expensive. As oxidation agent, nitrates and in particular sodium nitrate are used as a rule with chlorates or perchlorates being employed in exceptional cases. Polymers are used as organic binding agents. As color enhancing agents, halogen-containing compounds, in particular fluorine-containing or chlorine-containing metal salts are contained. When this fluorescent ammunition is burnt off, predominantly metal oxides such as magnesium oxide, sodium oxide and aluminum oxide, nitrogen, nitric oxides and carbon oxides and possibly hydrogen halides are created.

The German patent specification DE 42 21343 of the same applicant describes a process and device for working up pyrotechnical material, in which the pyrotechnical material is burnt off in a controlled manner in a tubular reactor and the resulting slag is optionally again reacted and the resulting raw gas is supplied through a high temperature area in order to decompose any still existing organic substances.

Subsequently, the raw gas is purified by various gas purification processes such that it can be released into the atmosphere as exhaust air.

The device of the prior art uses a discontinuous feeding device by means of which the material to be disposed of is fed to the tubular reactor.

It is a disadvantage in the process of the prior art according to DE 42 21 343 that, on the one hand, the resulting slag has to be reacted again and, on the other hand, that the device is operated discontinuously since, in case of a continuous feeding, great difficulties would occur in letting the pyrotechnical materials be burnt off in a controlled manner.

A further disadvantage of both processes is that essentially only one kind of pyrotechnical material can be fed per charge.

In comparison, the German patent specification DE 44 44 809 achieves an improvement in that this prior art describes the use of two separate reactors, a so-called burn-off chamber and a separate reactor. According to the process of DE 44 44 809, a specific pyrotechnical material is caused to react in the burn-off chamber while simultaneously another pyrotechnical material is burnt-off in a controlled manner in the second reactor. The slag created in the second separate reactor is locked out and then optionally again reacted in the burn-off chamber so that here at least two different pyrotechnical materials can be simultaneously processed in one plant.

A first approach to conduct different pyrotechnical materials in continuous operation through a single plant can be found in the German patent specification DE 195 09 196. According to this process of the prior art, the material to be disposed of is filled into a container, which is then supplied to a first burn-out chamber in which the bodies are heated to ignition temperature and optionally left to smoulder off in one or several further burn-out chambers, with the bodies being directly heated with broad-flame burners at a temperature within the range of 300° C. to 500° C. The smoke gases are here continuously sucked off and supplied to a thermal subsequent treatment and then further purified in an environmentally acceptable manner via known purification processes.

The burn-out chambers are arranged in the form of tunnel segments. The containers receiving the material to be disposed of are, according to the prior art of DE 195 09 196, conducted through the individual burn-out chambers on rails by means of pneumatically operated slides. The charge and discharge of the containers occurs by means of corresponding locks via a roller conveyor.

However, the high mechanical expenditure of the total container transport mechanism and the energetically unfavorable direct heating of the containers within the burn-out chambers are disadvantages of this process.

Starting from this prior art, it is therefore the object underlying the present invention to provide a process and a device for waste disposal of materials, which are and/or contain explosive active masses, which can be operated continuously and which can simultaneously be charged with different materials of an essentially wider scope of application, and which at least largely avoid the disadvantages of the prior art.

SUMMARY OF THE INVENTION

According to the invention, materials which are and/or contain explosive active masses are charged into a zone of high temperature, conveyed into a reaction zone, while at the same time the materials are sectioned into compartments during conveyance, followed by thermal reaction of the materials in an oxygen-containing environment and a fractionate discharging of the solid, liquid and gaseous reaction products.

On the one hand, the process according to the invention has the advantage that it can be continuously operated since the plant can be continuously charged due to the continuous conveyance.

Furthermore, different materials can be disposed of at the same time since compartments are formed during conveyance. This forming of compartments or chambers has, on the one hand, the effect that different materials can be reacted without their thermal reactions interfering with each other. On the other hand, the forming of compartments prevents parts from flying around, for example cartridge cases, during vigorous thermal reaction within the reaction zone.

The zone of high temperature is charged by-means of a downpipe and/or by means of a lock and/or by means of a carrier means, in particular a lance. This results in the advantage that different materials can be processed in one and the same plant.

If necessary, the waste disposal process or the waste disposal plant, respectively, can also be operated in charges of one specific material so that, for example for hand grenades or fixed ammunition or luminaries, certain process parameters, such as duration, temperature, conveyor speed or the like, can be finely matched to the respective material.

As a particular advantage, the materials to be disposed of are conveyed by means of a screw, in particular by means of a screw within a rotary cylindrical furnace.

However, it is also possible to convey the materials to be disposed of by means of a conveyor belt, in particular a chain belt conveyor, within the zone of high temperature and the reaction zone. The formation of compartments necessary for the processing of different materials and for the controlled course of the process is preferably achieved, in that, for example, the conveyor screw of a rotary cylindrical furnace or a second screw, respectively, is constructed such that the helix of the turns of the screw have a specific height so that within the reaction zone compartments are formed between the single helix or screw turns. A formation of chambers or compartments, respectively, can also be achieved by means of ribs and/or curtains, preferably chain curtains.

Advantageously, solid, liquid and pasty materials can be used.

The gaseous reaction products are advantageously fed to a dust separator and a high temperature reactor, in particular, with the dust separator and the high temperature reactor being formed as a structural unit. This has the advantage that, on the one hand, as soon as possible after leaving the reaction zone, the gas is at least largely freed of dusts such as for example $PbO_2$, $Al_2O_3$, $PbCl_2$, $AlCl_3$, CaO, CdO, $SnO_2$, $Sb_2O_3$, CuO, ZnO, and the subsequent gas treatment is no longer disturbed by such dusts. As dust separator, a cyclone dust separator is preferably used.

One part of the waste gas roughly dedusted via the dust separator is recycled to the zone of high temperature with the addition of external heat, for example by means of a propane/fuel oil burner. This has in particular advantages with respect to process technology (i.e. temperature control adapted to the product, comparatively the temperature gradients via the rotary cylinder and avoiding extreme local temperature peaks; controlled decrease of the oxygen value in the circulation gas and thus in the locked out smoke gas as calculation basis for the pollutant emission amounts) and advantages in energetic respect, with a high operating safety and variability in the process being achieved in addition to the economic efficiency.

In order to essentially free the non-recycled exhaust portion of the smoke gas from organic components, for example dioxins, furans, CO and other organic carbon compounds, this portion of the exhaust gas is advantageously fed into a high temperature reactor.

The exhaust gas emitting from the high temperature reactor, preferably after cooling in a suitable cooling means, is subjected to further purification steps. The advantage in the purification steps is based on the circumstance that specific chemical components can be removed from the gas due to a specific down-stream gas purification step, so that an exhaust air is achieved which is environmentally compatible.

Preferably, in the present process, waste heat and/or heat created during chemical reactions is recovered via heat exchangers and this heat is recycled into the process at suitable points. These measures considerably lower the energy costs for the present process according to the invention.

A device for carrying out the process according to the invention, with the device having a feeding head for charging the materials to be disposed of, at which at least one charging means is provided, with the feeding head opening into a rotary cylindrical furnace, the rotary cylinder of which comprises a consecutive helix connected with the wall for forming compartments and for conveying the materials to be disposed of, with the rotary cylindrical furnace being heated by means of supplying hot gas in the direction of conveyance of the materials into its interior and in the interior an indirect ignition of the materials occurs, with the reaction products being fractionated into solid, liquid and gaseous products at the exit by means of at least one fractionating means. As solid products, there are for example the metal shells of hand grenades and fixed ammunition. As liquid products, there can be for example liquid lead.

Such a rotary cylindrical furnace is, due to the waste disposal of explosive substances, advantageously formed as armoured rotary cylindrical furnace. The measures have the advantage that, on the one hand, an additional formation of compartments is achieved and, on the other hand, the deflector segments prevent that ammunition is already ignited or detonates in the entrance area within the rotary cylindrical furnace due to insufficient conveyance and thus results in damaging the furnace.

A further independent attainment of the object defined above is a device for carrying out the process according to the invention. In addition to the above-mentioned rotary cylindrical furnace, in particular armoured rotary cylindrical furnace, a through-type furnace heated in the outer casing can be used in whose lower area, a continuous chain conveyor is provided. For providing compartments in the case of the through-type furnace, ring-shaped impact plates and/or chain curtains are provided. In the rotary cylindrical furnace as well as in the through-type furnace, the materials are indirectly ignited and burnt off in a controlled manner without direct flames reaching from one burner to the materials to be disposed of.

In the rotary cylindrical furnace as well as in the through-type furnace, a fractionating unit is provided at the exit by means of which it is possible to fractionate the reaction products into solid, liquid and gaseous products.

Practice proved a chain conveyor within the through-type furnace to be particularly advantageous, which is conducted via a labyrinth lock in the feeding area of the through-type furnace and within the through-type furnace though a structurally adapted floor area.

The measures have the advantage that in-leaked air is avoided due to the swing valve system provided.

There is a vacuum in the reaction zone which lies inside the rotary cylinder furnace or the through-type furnace, respectively. This has the advantage that the reaction can take place in a controlled manner without large quantities of contaminated furnace air being able to exit into the atmosphere. For creating the vacuum, a suction fan is preferably used.

The use of a screening drum as fractionating means has the advantage that a three-phase separation can easily be achieved thereby. Liquid matter can flow through the perforations of the screen and into suitable collecting containers, whereas solid matter, such as grenades or cartridge cases, which do not fit through the perforations, can be locked out into another suitable collecting container. The gaseous reaction products, being quasi unhindered by the screening drum, are fed into the subsequent gas treatment plants.

Further advantages and features of the present invention result from the description of the embodiments and also from the drawings.

DETAILED DESCRIPTION OF THE INVENTION

Figure 1:
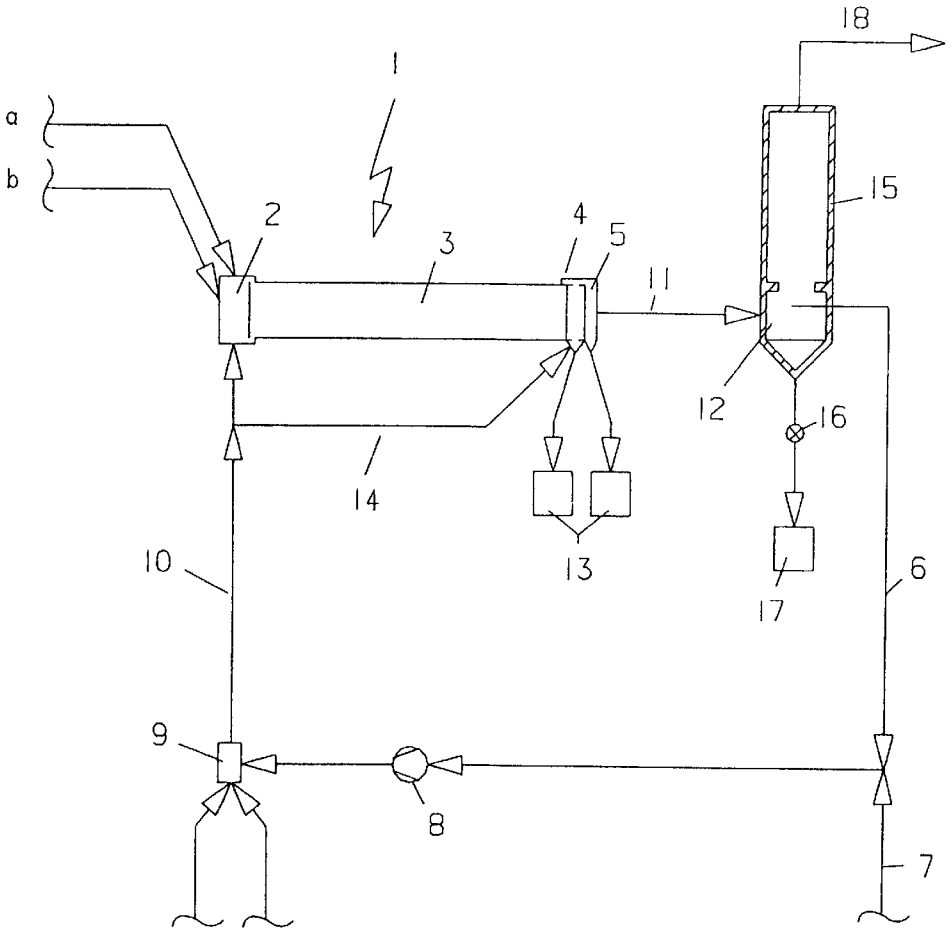
FIG. 1 shows a device according to the invention for carrying out the process according to the invention according to a first embodiment.

In FIG. 1, (1) designates an armoured rotary cylindrical furnace. At its entry, the armoured rotary cylindrical furnace (1) has a feeding head (2) which opens into the armoured rotary cylinder (3). At the exit (4) an inert material outlet is arranged as fractionating means (5).

In a reaction range under vacuum, which serves for thermally reacting pyrotechnical active masses, propellants, smoke compositions and irritants, subcaliber ammunition, in particular fixed ammunition, and phosphorus-containing ammunition and comprises the main components:

charging means (not shown)

armoured rotary cylinder high temperature section hot gas circulatory system and separating systems integrated into the process flow, two-base propellants of the following rough composition were used in armoured rotary cylinder (3):

Propellant:

cellulose nitrate: 50—50 mass-% nitroglycerine: 20–30 mass-% dinitrotoluene: ≦10 mass-% stabilizers: ≦10 mass-%

As inert material addition component, subcaliber ammunition was added for the local thermal and mechanical protection of the armoured rotary cylinder (3), which was preferably used due to its high metal inert material proportion in the form of steel scrap for economic reasons as compared to a purely inert material addition.

Subcaliber ammunition: inert material: approx. 85 mass-% propellant powder: approx. 15 mass-%

Whereas the propellant powder was comparable to the propellants in its composition, the inert material consisted predominantly of different surface protected steel shells with different filling materials (i.a. lead, bursting charges, incendiary and tracer projectiles etc.).

Addition of the feeding material (b) propellant and of the subcaliber ammunition as alternative component for the inert material (a) took place in phases in the feeding head (2) of the armoured rotary cylinder (3). For product transport and for portioning or forming compartments (safety aspect), the armoured rotary cylinder (3) is equipped with interior baffles in the form of a continuous helix cast with the walls of the armoured rotary cylindrical furnace, to which helix a second helix of identical gradient with a helix height of 20% of the height of the continuous helix was added in the feeding area over approx. 25% of the length of the armoured rotary cylinder (3). In addition, in the baffle plate area, which separates the rotary cylindrical part (3) from the feeding head (2), deflector plates are uniformly arranged along the circumference of the rotary cylinder feeding area between the helixes in order to prevent an accumulation of feeding materials in this region. With the baffle plate, which was designed like a weir, it was prevented that reacted or unreacted feeding material (b) is thrown back into the feeding head (2) during the course of the reactions in the armoured rotary cylinder (3).

The armoured rotary cylinder (3) was operated at an operating temperature at the exit of approx. 240 ° C. The (not shown) charging means downpipe technology lock technology and an alternative connection for injecting liquid or pasty goods to be disposed of, Which led through the baffle plate into the armoured rotary cylinder (3), were arranged in the feeding head (2) taking aspects of safety and production engineering into consideration.

The phased addition of the portioned, dry propellant occurred by means of conveying means via the downpipe technology in the feeding head (2) of the armoured rotary cylinder (3). The portioning of the propellant pieces was adapted to the inner width of the downpipe cooled in its outer casing, with the inner width of the downpipe being limited in the absolute dimension evaluating experience gained in the operation in order to avoid uncontrolled inleaked air. A discontinuous waste disposal of the residual or propellant fragments, which were caused by said portioning and which, due to their dimension and form, can result in shiftings in the downpipe resulting from non-directed charging, was ensured by means of the lock technology. Whereas mainly feeding materials (b) of defined physical shape were charged via the downpipe technology, the lock technology was preferably used for the charging of feeding material pieces (b). Propellant chips with added dispersion agent can be discontinuously disposed of in addition by injecting them i.a. as pasty mass into the rotary cylindrical furnace (1).

The charging of the subcaliber ammunition, in the described application example the ammunition type 5.6×39 mm in packaged form, was fed, for safety reasons separated from the propellants, via the lock technology, through which the general inert material charging in the case of mixed components operation was preferably carried out and which took place in staggered phase to the charging via the downpipe technology.

By means of directed recycling of hot circulating gas (6), which was likewise fed via the feeding head (2) into the armoured rotary cylinder (3), having a starting temperature of approx. 310 ° C., the feeding materials (b) are indirectly ignited and thermoreacted in the armoured rotary cylinder (3). Circulating gas and feeding material (b) were led through the armoured rotary cylinder (3) in parallel flow.

With the circulating gas operation and the regulation of the starting temperature of the recycled circulating gas 6 by means of a burner 9 lying outside the armoured rotary cylinder (3) and being integrated in the circulating gas pipe, a flexible operation scheme was achieved which has to be adapted to the respective feeding product spectrum, in connection with the varying rotational speed of the armoured rotary cylinder (3), taking aspects of safety technology into consideration, and a safely functioning plant operation was guaranteed.

Via duct 7, fresh air is mixed with the circulating gas 6 and fed to the burner 9 via fan 8. The circulating gas/air mixture heated by burner 9 is refed into the rotary cylinder (3) via duct 10.

Whereas the complete burn-out of the feeding materials (b) in the armoured rotary cylinder (3) could be regulated depending on the detention time via the variation of the rotational speed of the armoured rotary cylinder (3), a stable process operation was given with the circulating gas operation as compared to on-line operation, while a defined residual oxygen contents of clearly limited variation range was kept at phased charge.

Concentration variations in down-stream smoke gas purification steps are thereby largely smoothed over, controlling circuitry of smoke gas components become more manageable and exceeding pollution components in the pure gas are minimized.

With the circulating gas operation, a relatively uniform temperature distribution over the armoured rotary cylindrical furnace (1) was achieved as compared to on-line operation and thus a safe temperature control is guaranteed. Extreme local temperature peaks as a result of the thermal reaction of the single bodies are limited, the armoured rotary cylindrical furnace (1) is thermally relieved and a directed burn-off process at defined process conditions is ensured. Since the starting and continuous operation of the reaction part was maintained via the circulating gas system, a directed shutting down excluding the condensation of undesired, vaporizable metals and metal salts was the case.

Whereas the steel scrap of the caliber ammunition mixed with dust proportions, such as e.g. $PbO_2$, $Al_2O_3$, $PbCl_2$, $AlCl_3$, CaO, CdO, $SnO_2$, $Sb_2O_3$, CuO, ZnO, was withdrawn at the end of the rotary cylinder, the dust-loaded smoke gas (11) was conveyed to dedusting via a separator (12), in the example a cyclone dust separator. The residual oxygen content of the dust-loaded smoke gas (11) amounted to 12.7 vol.-% in dry gas. In order to avoid condensation of undesired vaporizable metals and metal salts in the inert containers (13), the fractionating means (5) was impinged with buffer gas (partial amount of circulating gas) (14) of defined quantity. As buffer gas (14), a partial amount of gas of the hot circulating gas stream 6 was used before its integration into the armoured rotary cylinder (3).

In the separator (12), which is located up-stream a high temperature reactor (15) for reasons of process technology, which due to constructional aspects is arranged directly below the high temperature reactor (15) in one unit and was carried out with a tangential introduction of the dust-loaded smoke gas (11), the gas was roughly dedusted from inorganic solid pollutants such as for example $PbO_2$, $Al_2O_3$, $PbCl_2$, $AlCl_3$, CaO, CdO, $SnO_2$, $Sb_2O_3$, CuO, ZnO. By means of rotary-vane lock (16), the dust discharge occurs from the separator (12) into the dust container (17) arranged below.

Whereas the main amount of the circulating gas 6 was withdrawn from the lower area of the high temperature reactor (15) from the separator (12), the decycled smoke gas is subsequently treated thermally via the high temperature reactor (15). The decycled circulating gas amounted to 38 mass-%, in proportion to the total circulating gas amount. In the high temperature reactor (15), the locked out smoke gas amount was subsequently treated thermally under defined technological parameters (detention time $\geqq 2$ sec., temperatures of approx. 1200° C.), in order to ensure a complete burn-out of organic components, e.g. dioxins, furans, CO and organic carbon.

With a residual oxygen contents of 9.1 vol.-% in dry gas, the smoke gas (18) subsequently treated thermally was withdrawn at the head of the high temperature reactor (15) and conveyed for quenching and further smoke gas purification to the downstream gas purification steps.

The temperature control of the high temperature reactor (15) occurs by means of a multicomponent burner arranged above the withdrawal location of the circulating gas, which was operated in the embodiment with fuel oil at a stoichiometric air requirement of $\lambda=0.1$.

The circulating gas stream was maintained via the flow-controlled hot gas fan 8 down-stream of which the burner 9 was located for controlling the starting temperature of the circulating gas 6, and via which the starting-up and the defined slowing-down operation of the hot-gas circulating system was carried out.

Due to the controlled supply of fresh air 7, the amount of the circulating gas stream was held constant taking the inleaked air into consideration. The fresh air supply occurred on the suction side of the hot-gas fan 8 into the circulating gas duct.

Undesired dust and smoke gas emissions, caused by pressure bursts, were prevented by means of the arrangement of the suction 8 and operation of the total plant under vacuum.

Figure 2:
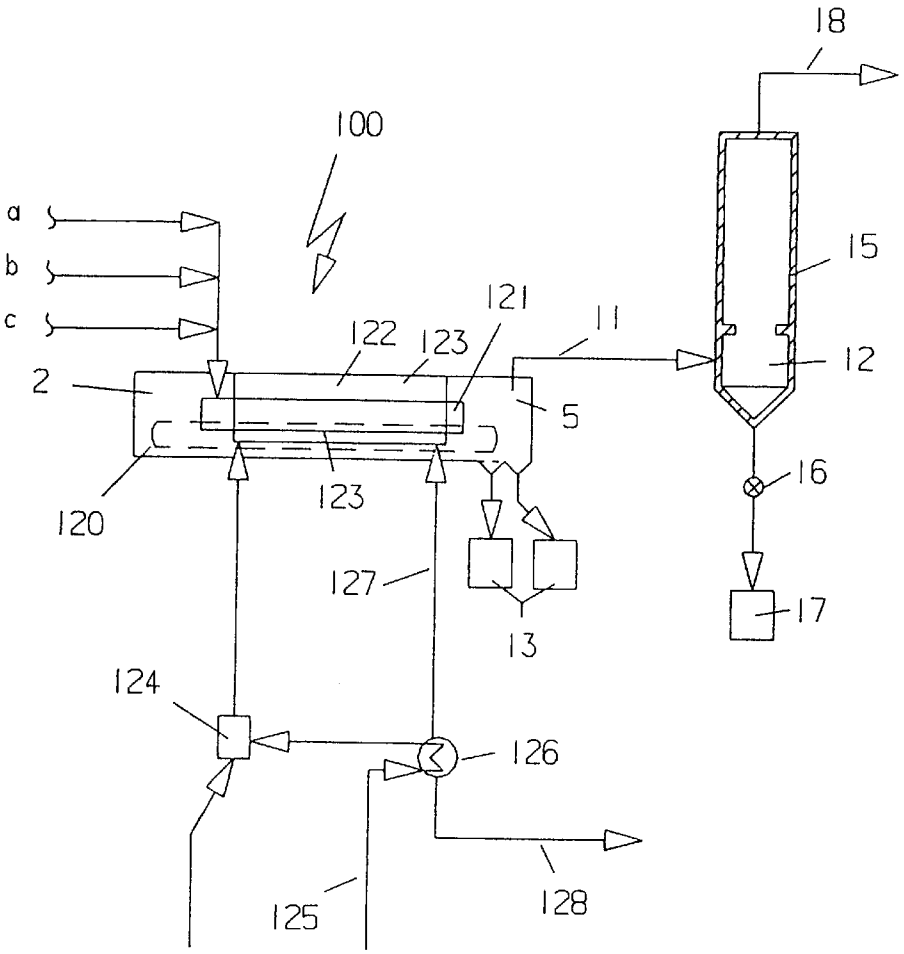
FIG. 2 shows a device according to the invention for carrying out the process according to the invention according to a second embodiment.

In FIG. 2, another embodiment of a device according to the invention is shown. Identical units have the same reference numbers as in FIG. 1.

Reference number 100 designates a through-type furnace. Via the paths a, (b) and c, the through-type furnace 100 is charged with materials to be disposed of, which are and/or contain explosive active masses.

A continuous chain conveyor (120) takes up material to be disposed of within the feeding head (2) and conveys it into the inner tube (121) of the through-type furnace 100. The inner tube (121) is enveloped by an outer casing (122), with the space (123) being flooded by hot gas for heating the inner tube (121). This hot gas is produced by a burner (124).

Material to be disposed of, as mentioned above, arrives on the chain conveyor (120) and is transported thereon into the interior of the through-type furnace 100. There it is indirectly ignited and burnt-off by the heat. On the one hand, the chain conveyors (120), as well as in the example (not shown in FIG. 2) chain curtains, serve for forming compartments. After the thermal reaction of the materials to be disposed of, the smoke gas (11) is treated analogously to FIG. 1. Contrary to the embodiment according to FIG. 1, however, no circulating gas is branched of.

As fractionating means (5) a screening drum is used in the example and the liquid and solid components of the reacted materials are collected in the containers (13). Preferably, the combustion air (125) is supplied in counter flow to the exiting fuel gas (127) via heat exchangers (126), with said fuel gas being thereby cooled and released into the atmosphere as normal exhaust air (128). The now preheated combustion air (125) is heated by the burner (124) to the desired temperature and supplied to the space (123).

What is claim is:

1. A process for disposing of materials which are and/or contain explosive active masses, comprising the following steps:

feeding the materials into a heating zone;

conveying the materials into a reaction zone and simultaneously forming compartments of the materials during conveyance;

thermally reacting the materials in a oxygen-containing environment; and fractionately discharging solid, liquid and gaseous reaction products.

2. A process according to claim 1, wherein the materials are fed into the heating zone by one or more conveyance means selected from the group consisting of a downpipe, a lock and a carrier device.

3. A process according to claim 1, wherein the materials are conveyed by means of at least one screw conveyor.

4. A process according to claim 1, wherein the materials are conveyed by means of a conveyor belt (120).

5. A process according to claim 1, wherein said compartments of the materials are formed during the conveyance by the threads of at least one screw.

6. A process according to claim 1, wherein said materials which are and/or contain explosive active masses are in the form of solid, liquid and/or pasty materials.

7. A process according to claim 1, wherein the gaseous reaction products are fed to a dust separator (12) and a high temperature reactor (15).

8. A process according to claim 7, wherein at least part of the waste gas (11) charged through the dust separator (12) is recycled into the heating zone and a partial amount of circulating gas (14) bypasses the heating zone and is fed into fractionating means (5).

9. A process according to claim 1, wherein said process operates in a continuous cycle with at least a portion of said gaseous reaction products being recycled to said reaction zone, and wherein said recycled gaseous reaction products provide heat for the starting-up operation and the product-specific temperature control of continuous operation of the rotary cylindrical furnace (1).

10. A process according to claim 1, wherein non-recycled waste gas is fed into a high temperature reactor (15) at a temperature of approx. 1200° C. to 1400° C.

11. A process according to claim 1, wherein the waste gases (18) exiting from the high temperature reactor (15) are subjected to purification.

12. A process according to claim 1, wherein said thermal reaction is exothermic, and wherein waste heat and heat created during chemical reactions is recovered via heat exchangers and said recovered heat is recycled into the process.

13. A device for carrying out a process for disposing of materials which are and/or contain explosive active masses, said process comprising: feeding said materials into a heating zone; conveying said materials into a reaction zone and simultaneously forming compartments of the materials during conveyance; thermally reacting said materials in a oxygen-containing environment; and fractionately discharging solid, liquid and gaseous reaction products, wherein said device includes:

a feeding head (2) for charging the materials to be disposed of, including at least one associated charging means, a rotary cylindrical furnace (1) in communication with said feeding head (2) said rotary cylindrical furnace (1) comprising a rotary cylinder (3) which comprises an internal wall and a consecutive helix screw connected with the wall for forming compartments and for conveying the materials to be disposed of, means for heating the rotary cylindrical furnace (1) comprising supplying hot gas (6) in the direction of conveyance of the materials into its interior such that an indirect ignition of the materials occurs, at least one fractionating means (5) downstream of said ignition for fractionating the reaction products into solid, liquid and gaseous products.

14. A device according to claim 13, wherein the rotary cylindrical furnace (1) is formed as an armored rotary cylindrical furnace.

15. A device according to claim 13, wherein the rotary cylinder (3) includes a baffle plate placed between the feeding head (2) and the rotary cylinder (3) and a second screw with a screw height of approx. 50% of the height of the continuous helical screw, with said second screw having deflector segments for material guidance at the entrance of said baffle plate.

16. A device for carrying out a process for disposing of materials which are and/or contain explosive active masses, said process comprising: feeding said materials into a heating zone; conveying said materials into a reaction zone and simultaneously forming compartments of the materials during conveyance; thermally reacting said materials in a oxygen-containing environment; and fractionately discharging solid, liquid and gaseous reaction products wherein said device includes:

a feeding head (2) for charging the materials to be disposed of, including at least one charging means provided in association therewith, a through-type furnace (100) heated in the outer casing, into which the feeding head (2) opens, with a continuous chain conveyor (120) being provided in the lower area thereof;

impact plates and/or chain curtains within the through-type furnace (100) for forming compartments therein;

wherein said through-type furnace (100) is heated in the outer casing sufficiently to cause an indirect ignition the materials occurring in the interior; and at least one fractionating means (5) at an exit of said through-type furnace (100) for fractionating the reaction products into solid, liquid and gaseous products.

17. A device according to claim 16, wherein said chain conveyor (120) is conducted via a labyrinth lock into the feeding areas of said through-type furnace (100) and within the through-type furnace (100) through a structurally adapted floor area.

18. A device according to claim 16, wherein said device comprises a swing valve system in the area of the fractionating means (5).

19. A device according to claim 13, further comprising means to provide a vacuum in the interior of the reaction zone.

20. A device according to claim 13, wherein the fractionating means (5) is a screening drum.

21. A waste disposal plant for materials which are and/or contain explosive active masses, comprising:

at least one device for carrying out a process comprising: feeding said materials into a heating zone; conveying said materials into a reaction zone and simultaneously forming compartments of the materials during conveyance; thermally reacting said materials in a oxygen-containing environment; and fractionately discharging solid, liquid and gaseous reaction products, wherein said device includes:

a feeding head (2) for charging the materials to be disposed of, including at least one associated charging means, a rotary cylindrical furnace (1) in communication with said feeding head (2) said rotary cylindrical furnace (1) comprising a rotary cylinder (3) which comprises an internal wall and a consecutive helix screw connected with the wall for forming compartments and for conveying the materials to be disposed of, means for heating the rotary cylindrical furnace (1) comprising supplying hot gas (6) in the direction of conveyance of the materials into its interior such that an indirect ignition of the materials occurs, at least one fractionating means (5) downstream of said ignition for fractionating the reaction products into solid, liquid and gaseous products;

a dust separation means (12) and a high temperature reactor (15) located down-stream thereof both being formed as a structural unit; as well as at least one further gas purification means.

22. A waste disposal plant according to claim 21, wherein in the high temperature reactor (15), the gaseous reaction product (11) is exposed to a temperature of approx. 1200° C. to 1400° C. for an average period of approx. 1 to 10 seconds.

23. A waste disposal plant according to claim 21, wherein the dust separating means (12) is a cyclone separator.

24. A process for disposing of materials which are and/or contain explosive active masses, comprising the following steps:

feeding the materials into a zone of high temperature of 310° C. or higher;

conveying the materials into a reaction zone and simultaneously forming compartments of the materials during conveyance;

thermally reacting the materials in a oxygen-containing environment; and fractionately discharging solid, liquid and gaseous reaction products.

25. A process according to claim 3, wherein said screw conveyor comprises at least one screw within a rotary cylindrical furnace (1).

26. A process according to claim 25, wherein compartments of the materials are formed during conveyance by the turns of the screw of the rotary cylindrical furnace (1).

27. A process according to claim 25, wherein compartments of the materials are formed during conveyance by the turns of a first screw and a second screw of the rotary cylindrical furnace (1).

28. A process according to claim 4, wherein said conveyor belt (120) is a chain conveyor belt.

29. A process according to claim 1, wherein compartments of the materials are formed during conveyance by forming chambers by means of ribs, curtains, or ribs and curtains.

30. A process according to claim 29, wherein said curtains are chain curtains.

31. A process according to claim 7, wherein said dust separator (12) and a high temperature reactor (15) are formed as a single structural unit, with the high temperature reactor (15) being located down-stream from the dust separator (12).

32. A process according to claim 11, wherein said waste gases (18) exiting from the high temperature reactor (15) are cooled via suitable cooling means prior to said purification steps.

33. A process according to claim 11, wherein said waste gases (18) exiting from the high temperature reactor (15) are subjected to at least one of the following purification steps:

wet purification, dry purification, chemical purification, and adsorptive purification.

34. A process according to claim 33, wherein said chemical purification is selected from the group consisting of NaOH, lime, and lime-coal; and wherein said adsorptive purification is selected from the group consisting of reaction of mercury in the presence of sulfur dioxide, filtration, and denitration.

* * * * *